US006099272A

United States Patent [19]

Armstrong et al.

[11] Patent Number: 6,099,272

[45] Date of Patent: Aug. 8, 2000

[54] PERISTALTIC PUMP WITH FLOW CONTROL

[75] Inventors: Keith Armstrong, Denison; Kevin Kemp, Dallas, both of Tex.

[73] Assignee: FSI International, Chaska, Minn.

[21] Appl. No.: 08/932,989

[22] Filed: Sep. 18, 1997

[51] Int. Cl.[7] ..... F04B 43/12

[52] U.S. Cl. ..... 417/476; 417/477.1; 417/477.9

[58] Field of Search ..... 417/476, 477.1, 417/477.9

[56] References Cited

U.S. PATENT DOCUMENTS

| | | | |
|---|---|---|---|
| 4,558,996 | 12/1985 | Becker . | |
| 4,568,255 | 2/1986 | Lavender et al. . | |
| 4,976,593 | 12/1990 | Miyamoto | 417/476 |
| 5,257,917 | 11/1993 | Minarik et al. | 417/475 |
| 5,468,129 | 11/1995 | Sundén et al. . | |
| 5,470,211 | 11/1995 | Knott et al. | 417/477.9 |
| 5,482,447 | 1/1996 | Sundén et al. . | |
| 5,630,711 | 5/1997 | Luedtke et al. | 417/477.9 |

FOREIGN PATENT DOCUMENTS

| | | | |
|---|---|---|---|
| 0 532 300 A2 | 3/1993 | European Pat. Off. | 417/476 |
| 59-165883 | 9/1984 | Japan | 417/477.1 |
| 2-70987 | 3/1990 | Japan | 417/477.1 |
| WO 88/05868 | 8/1988 | WIPO . | |

*Primary Examiner*—Timothy S. Thorpe
*Assistant Examiner*—Cheryl J. Tyler
*Attorney, Agent, or Firm*—Mueting, Raasch & Gebhardt, P.A.

[57] ABSTRACT

A rotary peristaltic pump that can supply fluids accurately at desired flow rates and with the desired control over pulsations normally experienced when using peristaltic pumps. The control is provided, in one aspect, by varying the radius of the shell against which the compression devices act to deform the tubing. In another aspect, the torque needed to turn the rotor is equalized throughout the rotation of the rotor to further enhance the flow rate accuracy of the pump. Torque equalization is preferably enhanced by use of a torque control cam positioned about the rotor.

19 Claims, 3 Drawing Sheets

PERISTALTIC PUMP WITH FLOW CONTROL

FIELD OF THE INVENTION

The present invention relates to the field of peristaltic pumps. More particularly, the present invention relates to rotary peristaltic pumps incorporating shells with a varying radius and/or a torque control cam to assist in controlling flow from the pump.

BACKGROUND OF THE INVENTION

Peristaltic pumps are devices used to pump fluids contained in compressible tubes. The fluids are moved through the tubing by compressing the tubing with a roller or similar device and moving the area of compression along the length of the tube to force the fluid through the tube. In a rotary peristaltic pump, the rollers or other compression devices are typically contained on a rotor that is rotated to provide the desired movement.

One advantage of peristaltic pumps is their relatively simple design. Another advantage is that contamination of the fluids being pumped is not an issue when using peristaltic pumps because the fluid being pumped does not come into contact with anything but the tubing (which in many applications is disposable). Peristaltic pumps are also relatively insensitive to variations in the viscosity of the fluids being pumped as well as pressure fluctuations in the system. The use of peristaltic pumps may also reduce or eliminate the need for isolation valves as the compression of the tube can isolate the upstream fluid from the downstream fluid.

Although peristaltic pumps provide a number of advantages, they do suffer from some drawbacks. One disadvantage is that the fluid flow from peristaltic pumps is typically characterized by pulsations as the tubing is compressed and uncompressed during pumping. Furthermore, highly accurate flow rate may be difficult to achieve due to the pulsating flow. Another factor that may contribute to pulsations is that, in rotary peristaltic pumps incorporating compression devices on a rotor, highly accurate control of the rotor is difficult to attain due to the torque variations as the compression devices alternately compress the tubing and then release the tubing. Those torque fluctuations, combined with the pulsations caused by compression and decompression of the tubing, make highly accurate control over the fluid flow rate from a rotary peristaltic pump difficult to achieve.

Attempts at controlling pulsation and flow rate when using peristaltic pumps have included the use of controllers to vary the speed of the compression devices, using parallel peristaltic pumps in which the fluid flow pulses are offset in a balanced manner, and using additional devices downstream from the pump to counteract the pulsations produced by the pump.

None of these approaches have, however, provided the desired flow rate control in conjunction with control over pressure variations, especially in applications where flow rates are relatively low and the need for accuracy is high. One such application is in the delivery of semiconductor lithography process fluids including photoresists, solvents, developers, water, etc. These fluids are typically applied in carefully controlled amounts during the construction of an integrated circuit on a semiconductor wafer. Typical flow rates required in these applications range from about 0.1 to about 100 cubic centimeters per second and it is highly desirable that pulsations in the fluid flow be controlled during delivery.

As a result, a need exists for a rotary peristaltic pump that can supply fluid accurately at desired flow rates and with the desired control over pulsations normally experienced when using peristaltic pumps.

SUMMARY OF THE INVENTION

The present invention provides a rotary peristaltic pump that can supply fluids accurately at desired flow rates and with the desired control over pulsations normally experienced when using peristaltic pumps. The control is provided, in one aspect, by varying the radius of the shell against which the compression devices act to deform the tubing. In another aspect, the torque needed to turn the rotor is equalized throughout the rotation of the rotor to further enhance the flow rate accuracy of the pump.

In one aspect, the present invention provides a rotary peristaltic pump having a rotor rotating about an axis of rotation; a race positioned about at least a portion of the rotor, wherein the race includes an arcuate surface curving around the axis of rotation and further wherein the arcuate surface has a radius as measured from the axis of rotation that varies; and a compression device mounted on the rotor, wherein the compression device is adapted to compress a portion of tubing located between the race and the rotor to pump a fluid through the tubing as the rotor rotates.

In another aspect, the present invention provides a rotary peristaltic pump having a rotor rotating about an axis of rotation; a race positioned about at least a portion of the rotor, the race including an arcuate surface curving around the axis of rotation, the arcuate surface comprising at least first, second, and third sections, the second section being located between the first and third sections, wherein the radius of the first section decreases in the direction of rotation of the rotor, the radius of the second section is substantially constant, and the radius of the third section increases in the direction of rotation of the rotor; and a compression device mounted on the rotor, wherein the compression device is adapted to compress a portion of tubing located between the race and the rotor to pump a fluid through the tubing as the rotor rotates.

In another aspect, the present invention provides a rotary peristaltic pump having a rotor adapted for rotation about a first axis; a plurality of compression devices mounted on the rotor; wherein the compression devices move in a path about the first axis when the rotor is rotated; a race positioned about a first portion of the path of the plurality of compression devices; and a torque control cam positioned about a second portion of the path of the plurality of compression devices, wherein the pump is adapted to compress a portion of tubing located between the race and at least one of the plurality of compression devices along the first portion of the path while at least one of the plurality of tube compression devices acts against the torque control cam along the second portion of the path.

In another aspect, the present invention provides a rotary peristaltic pump having a rotor adapted for rotation about a first axis; a plurality of compression devices mounted on the rotor; wherein the compression devices move in a path about the first axis when the rotor is rotated; a race positioned about at least a portion of the rotor, wherein the race includes an arcuate surface curving around the axis of rotation and further wherein the arcuate surface has a radius as measured from the axis of rotation that varies; and a torque control cam positioned about a second portion of the path of the plurality of compression devices, wherein the pump is adapted to compress a portion of tubing located between the arcuate surface and at least one of the plurality of compression devices along the first portion of the path while at least one of the plurality of tube compression devices acts against the torque control cam along the second portion of the path.

These and other features and advantages are described more completely below.

DETAILED DESCRIPTION OF THE INVENTION

Figure 1:
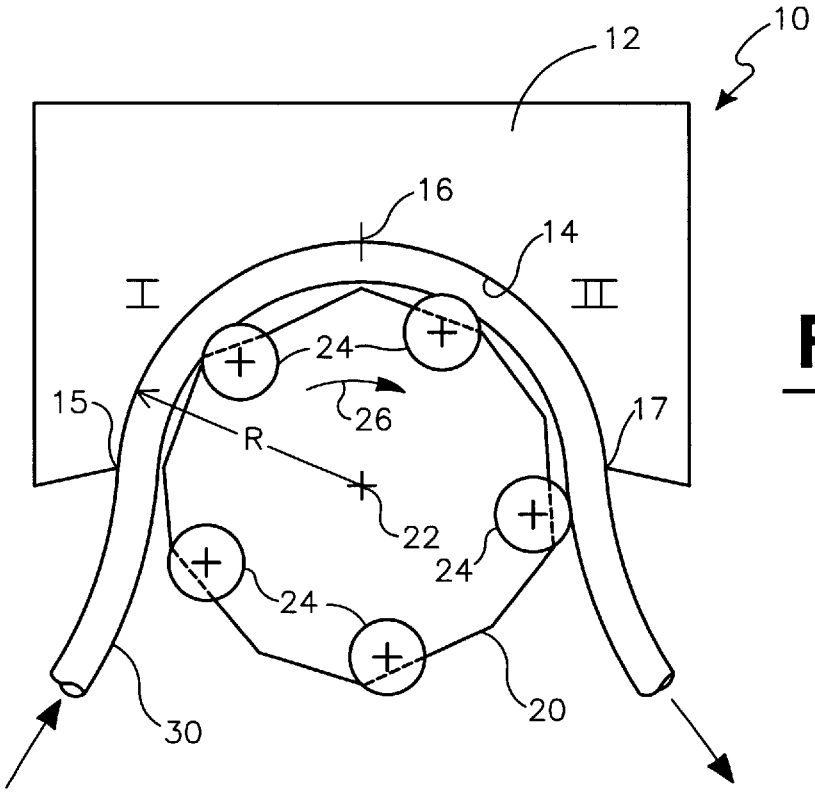
FIG. 1 is a schematic diagram of one peristaltic pump according to the present invention.

Referring now to FIG. 1, a peristaltic pump 10 is schematically depicted. The pump 10 includes a shell 12 having a race 14. Also included in pump 10 is a rotor 20 that includes compression devices 24, referred to below as rollers, mounted around its perimeter. The rollers 24 are preferably evenly spaced about the rotor 20. Rotor 20 rotates about an axis of rotation 22 in the direction shown by arrow 26. A flexible tube 30 is located between the rotor 20 and the race 14 which includes an arcuate surface curving around the axis of rotation of the rotor 20. As rotor 20 rotates about axis of rotation 22 each of the rollers 24 compress the tubing 30 against race 14 to move fluid through the tube as is well known in peristaltic pumps.

It will be understood that, except as discussed otherwise below, the number of rollers 24 provided on rotor 20 is a matter of design choice. As a result, although rotor 20 is depicted as having five rollers 24, it will be understood that any suitable number of rollers could be provided on rotor 20. In a further variation, it will also be understood that although rollers 24 may be preferred as compression devices to compress tubing 30 against race 14, other compression devices could also be used including devices that may be fixed, i.e., are not rotatable. It is, however, preferred that the compression devices used to compress tubing 30 be rotatable to minimize friction and wear between the compression device and the tubing.

Thus far, this discussion has described features that are well known in rotary peristaltic pumps. A peristaltic pump 10 of the present invention, however, incorporates a race 14 having an arcuate surface curving around the axis of rotation 22 that has a non-constant varying radius as measured from the axis of rotation 22 of the rotor 20, whereas typical rotary peristaltic pumps have shells in which the radius as measured from the axis of rotation of the rotor is constant, i.e., the radius does not vary. That radius, R, is varied in pump 10 according to the present invention to control or preferably reduce the pulsations in fluid flow emanating from the peristaltic pump 10. As used in connection with the present invention, "radius" and its variations will be used to refer to the distance between the axis of rotation 22 of the rotor 20 and the race 14.

In one embodiment depicted in FIG. 1, the race 14 includes Sections I and II which meet at a transition point 16 as depicted in FIG. 1. Although transition point 16 is depicted as being located at the midpoint of the race 14, it will be understood that it could be located at any point along the race 14. To reduce pulsations, at least one of the sections of the race 14 has a constant radius while the other has either a decreasing or increasing radius.

If Section II of the race 14 has a constant radius, the radius of Section I of the race 14 preferably decreases along the race 14 in the direction of rotation 26. In other words, the radius is smaller near the transition point 16 than near the entrance point 15 of the race 14. As a result, compression of the tubing 30 by each roller 24 increases as the roller 24 approaches the transition point 16. That decreasing radius in Section I can help to reduce pulsation that could be caused by abruptly compressing the tubing 30 to its greatest extent at the entrance point 15 to the race 14. Instead, the compression is preferably gradually increased as the roller 24 travels along race 14 towards transition point 16.

If Section I of the race 14 is provided with a constant radius then the radius of Section II of race 14 preferably gradually increases along the race 14 in the direction of rotation 26. In other words, the radius is larger near the transition point 16 than near the exit point 17 of the race 14. As a result, compression of the tubing 30 by each roller 24 decreases as the roller 24 approaches the exit point 17 of the race 14. That increasing radius in Section II can help to reduce pulsation that could be caused by abruptly releasing compression on the tubing 30 at the exit point 17 of the race 14. Instead, the compression is decreased as the roller 24 travels along race 14 away from transition point 16.

The variations in the radius of the sections of the race 14 may be linear, step-wise, or may follow any other desired function. It may, however, be preferable that any variations in radius be relatively smooth or gradual over the length of each of the sections to prevent causing unwanted pulsations in fluid flow from the pump 10. In some instances, however, it may be desirable to purposely induce pulsations, in which case the radius of race 14 may vary in a stepwise or other manner which induces pulsation into the fluid flow emanating from tube 30.

Figure 2:
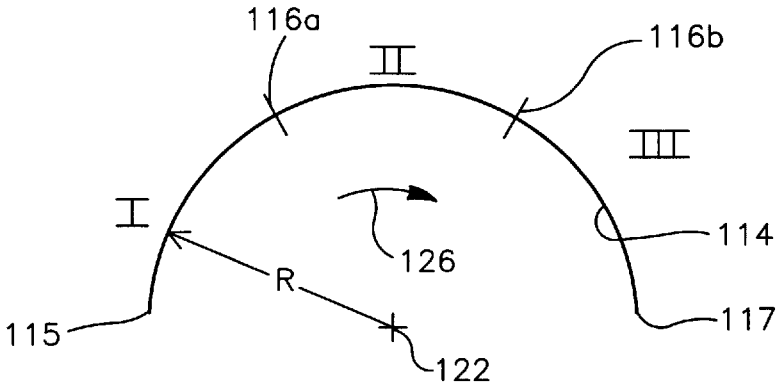
FIG. 2 is a schematic diagram of the shape of a race useful in a peristaltic pump according to the present invention.

Turning now to FIG. 2, an alternate embodiment of the design of a race 114 is schematically depicted. The race 114 includes three sections, rather than the two sections depicted in the race 14 of FIG. 1. As with the race 14, at least one of the sections has a constant radius. In the depicted embodiment, Section II preferably has a substantially constant radius while the radius of Section I as measured from the axis of rotation 122 of a rotor (not shown), preferably decreases along the direction of travel indicated by arrow 126. In other words, the radius is smaller near the transition point **116*a* than near the entrance point 115 of the race 114. As a result, compression of the tubing by each roller preferably gradually increases as the roller approaches the transition point 116*a*. That decreasing radius in Section I can help to reduce pulsation that could be caused by abruptly compressing tubing to its greatest extent at the entrance point 115 to the race 114. Instead, the compression is increased as each roller travels along race 114 towards transition point 116***a*.

The radius of Section III is preferably increasing along the direction of travel of arrow 126. As a result, compression of tubing by each roller preferably gradually decreases as the roller approaches the exit point 117 from the race 114. That increasing radius in Section III can help to reduce pulsation that could be caused by abruptly releasing compression on the tubing at the exit point 117 of the race 114. Instead, the compression is decreased as the roller travels along race 114 away from transition point 116*b*.

It may be useful in some instances to vary the radius of the race 114 in only one portion of the race. As described above, it may be helpful to provide a varying radius in Section I, maintain a substantially constant radius in Section II, and provide a varying radius in Section III. Alternately, it may be helpful to provide a varying radius in Section II while maintaining a substantially constant radius in Section I and/or Section III. Furthermore, any suitable combination of sections having varying and constant radii may be used to achieve the desired effect on fluid flow. In that regard, it will be understood that although races having two or three sections have been depicted herein, races having four or more sections with constant or varying radii may also be provided within the scope of the present invention.

The variations in radius within each of the sections, if any, may be smooth, i.e., gradual, or stepwise depending on the desired effect to be induced by the peristaltic pump. In the embodiment depicted in FIG. 2, however, the variation is preferably smooth or gradual over the length of the section when it is desired to reduce pulsations in fluid flow.

Figure 3:
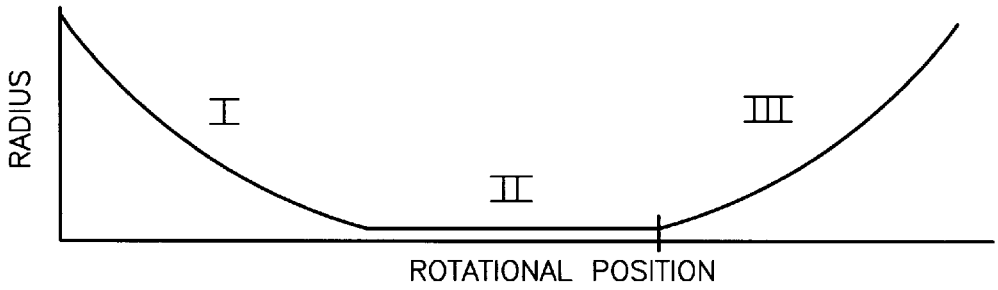
FIG. 3 is a graphical representation of the radius of the race depicted in FIG. 2, where rotational position is represented on the horizontal axis and the radius of curvature is represented on the vertical axis.

FIG. 3 graphically represents the radius along the race 114 schematically represented in FIG. 2. The graph of FIG. 3 measures rotational position along the race 114 on the horizontal axis and radius along the vertical axis. The radius of Section I is shown as decreasing in a smooth (gradual) manner, while the radius of Section II is substantially constant. The radius of Section III smoothly increases. It is typically preferred that the increasing radius of Section III mirrors the decrease in radius of Section I, i.e., the radius of Section III increases by substantially the same amount and at the same rate (where rate is a function of the rotational position of the rotor) as the radius of Section I decreases. It will be understood, however, that the increase in radius of Section III is not required to be equal in magnitude and/or rate to the decreases in the radius of Section I.

The actual variations in the radius of sections of the race can be based on a variety of factors including, but not limited to: tubing diameter, tubing wall thickness, modulus of the tubing material, etc. The actual variations in the radius will typically be arrived at by empirical observation. In one example of a race including three sections (e.g., race 114), the radius of Section II is preferably constant at about 2.8 inches while the radius at both the entrance point 115 of Section I and the exit point of Section III is about 2.94 inches. As a result, the radius of the race over Section I decreases from about 2.94 inches at entrance point 115 to about 2.8 inches at transition point 116*a* and the radius increases from about 2.8 inches at transition point 116*b* to about 2.94 inches at exit point 117.

The length of each of the sections in the races 14 and 114 are preferably equal and will preferably be based on the number of rollers present in the rotor using the formula 360/n where n is the number of rollers. For example, where the rotor includes five rollers, the length of each section of the race is an arc of 72° (around the axis of rotation of the rotor).

Figure 4:
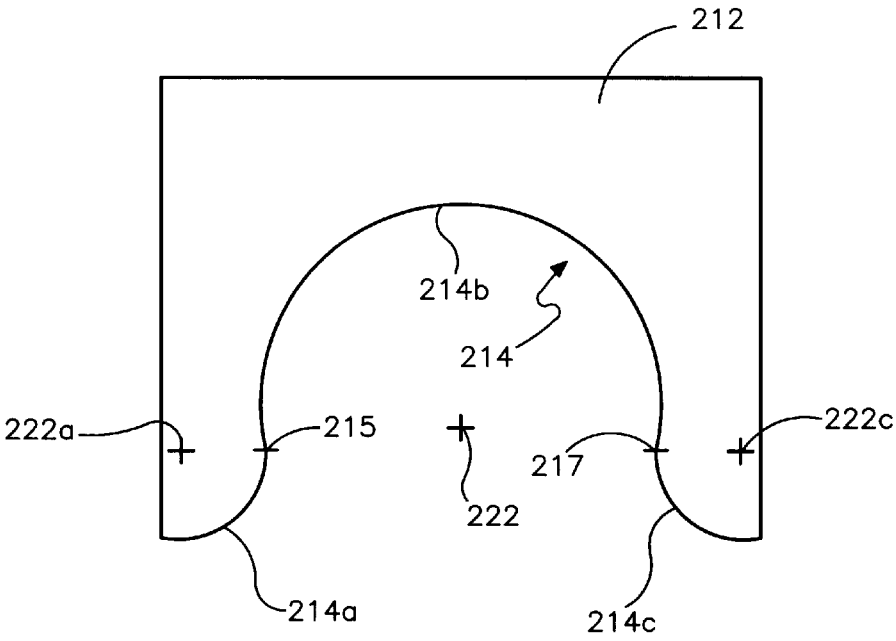
FIG. 4 is a schematic diagram of the shape of an alternative race useful in a peristaltic pump according to the present invention.

The descriptions of peristaltic pumps according to the invention above have focused on the varying radius of the arcuate surface curving around the axis of rotation of the rotor. It should, however, be understood that the races in peristaltic pumps according to the present invention may also include portions outside of the arcuate surfaces described above in which the race curves away from the axis of rotation of the rotor. Such a design is depicted in FIG. 4 where the shell 212 of a peristaltic pump is depicted which includes a race 214 having an arcuate surface 214*b* that curves around the axis of rotation 222 of a rotor (not shown) between points 215 and 217. The race 214 may also include an entry portion 214*a* that joins with the arcuate surface 214*b* at point 215 and curves away from the axis of rotation 222 as shown in FIG. 4. Portion 214*a* preferably curves around a point 222*a* located on the opposite side of the line defining the arcuate surface 214*b* from axis of rotation 222. The race 214 may also include an exit portion 214*c* that joins with arcuate surface 214*b* at point 217 and curves away from the axis of rotation 222. Portion 214*c* preferably curves around a point 222*c* located on the opposite side of the line defining the arcuate surface 214*b* from axis of rotation 222.

The dimensions of any such additional portions 214*a* and 214*c* could vary. One example of the design of potentially useful portions 214*a* and 214*c* is contained in U.S. Pat. No. 4,568,255 to Lavender et al. (referred to there as "surge release radii"). Regardless of whether the races of peristaltic pumps include such additional portions such as, e.g., portions 214*a* or 214*c*, all of the peristaltic pumps according to the present invention will include an arcuate surface that curves around the axis of rotation of the rotor and which also has a varying radius as described above.

The above described variations in radius along an arcuate surface of a race in a peristaltic pump may be helpful in reducing pulsations in fluid flow from that pump. Another issue when trying to reduce pulsations in fluid flow from a peristaltic pump are variations in torque needed to advance the rotor of the pump. Variations in torque occur as rollers or other compression devices come into contact with and compress the tubing, move along the length of the tubing and then release from the tubing at the exit point between the race and the compression device. Those variations in torque make it difficult to adequately control the speed of the rotor when highly accurate fluid flow is desired because they can cause changes in the speed of the rotor. As the speed of the rotor varies, changes in fluid flow rate can occur.

Figure 5:
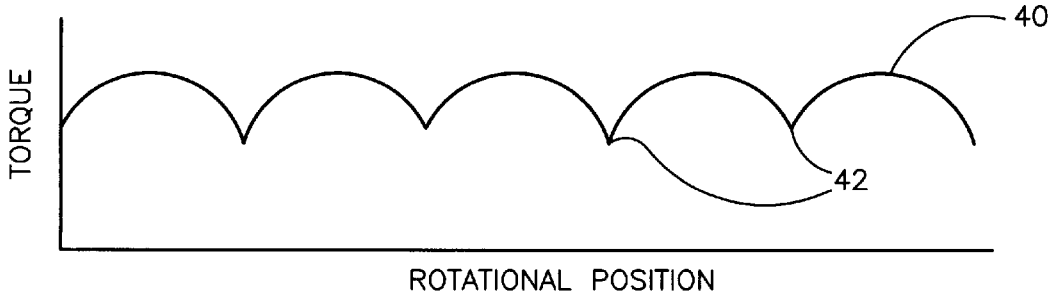
FIG. 5 is a graphical representation of torque required to rotate the rotor in a conventional rotary peristaltic pump, where rotational position is represented on the horizontal axis and torque is represented on the vertical axis.

Those variations in torque needed to advance the rotor of a rotary peristaltic pump are depicted graphically in FIG. 5 where rotational position of the rotor is depicted along the horizontal axis and the torque necessary to advance the rotor is depicted along the vertical axis. The line 40 represents torque required to advance the rotor and, as seen, the torque varies periodically. The minima 42 depicted in line 40 generally correspond to the point at which each compression device is released from the race. The spacing of the minima will vary depending on the number of compression devices provide on the rotor. For example, in a pump including a rotor having five evenly-spaced compression devices, the minima will be dispersed along line 40 at 72° intervals in the rotation of the rotor.

Although attempts can be made using a motor controller to adjust for the variations in torque required to advance a rotor in a rotary peristaltic pump, accurate compensation may be difficult due to the variations in torque based on the tubing being used in the peristaltic pump, the fluid being pumped (i.e., viscosity may change the torque required to rotate the rollers along the tubing), and other factors as well.

Figure 6:
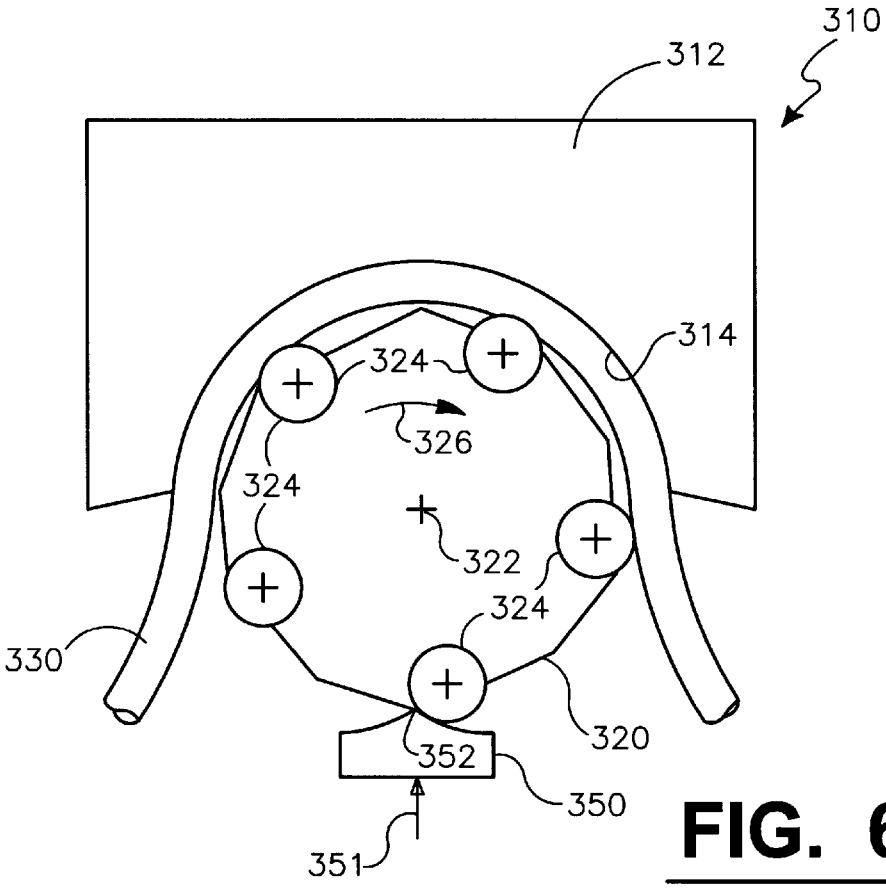
FIG. 6 is a schematic diagram of one rotary peristaltic pump according to the present invention that includes a torque control cam.

Turning to FIG. 6, the present invention addresses the issue of torque variations by providing a torque control cam 350 positioned about the rotor 320 in the area not occupied by the shell 312 and race 314 in a rotary peristaltic pump 310. The torque control cam 350 is positioned to act against the rollers 324 as they move about the axis of rotation 322 of the rotor 320. The torque control cam 350 preferably includes a peak 352. When each roller 324 passes the peak 352 on the torque control cam 350, the torque required to advance the roller 324 past the peak 352 is preferably at a maximum. It is also preferred that the peak 352 be positioned such that the maximum torque required to advance the roller 324 in contact with the torque control cam 350 past the peak 352 occur at the same time as another roller 324 exits from the race 314.

Figure 7:
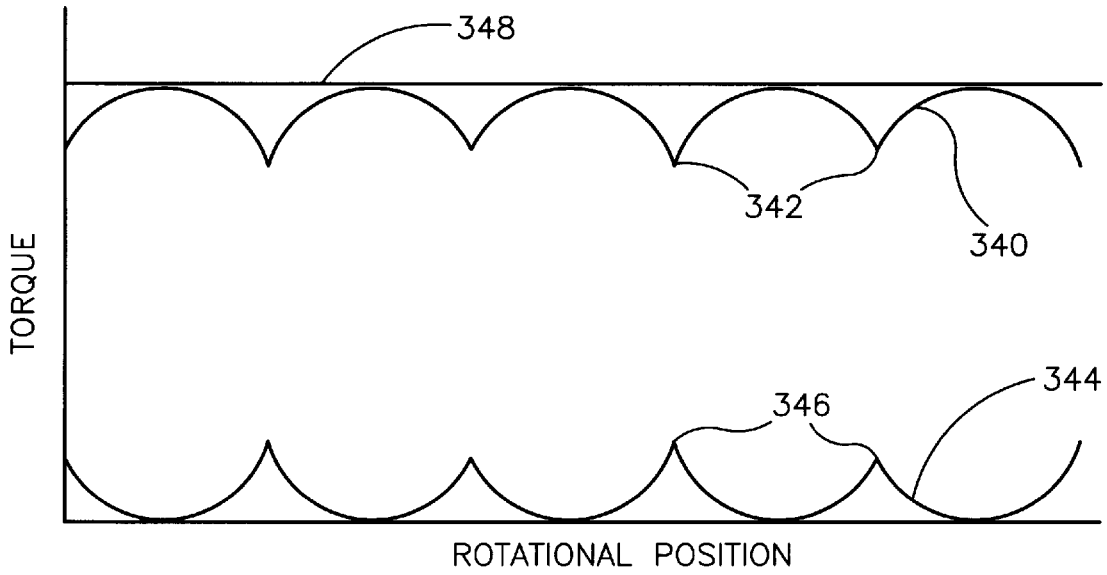
FIG. 7 is a graphical representation of torque required to rotate the rotor in one rotary peristaltic pump including a torque control cam, where rotational position is represented on the horizontal axis and torque is represented on the vertical axis.

Turning now to FIG. 7, where the torque required to rotate the active rollers 324, i.e., the rollers compressing tubing against the race 314 is depicted by line 340. As with a conventional rotary peristaltic pump, the torque curve includes a series of minima 342 dispersed along the line 340. Also depicted in the graph of FIG. 6 is the torque required to move a roller 324 along torque control cam 350 (indicated by line 344). The horizontal axis of the graph of FIG. 7 depicts the rotational position of the rotor 320 while the vertical axis depicts the torque necessary to turn the rotor 320 about the axis of rotation 322. As discussed above, the peak torque necessary to rotate a roller 324 across torque control cam 350 occurs at a series of periodic maxima 346 in line 344. Each of the maxima preferably occurs at the same rotational position as the minima 342 in the torque necessary to rotate the active rollers 324. As a result, the total system torque, depicted by line 348, is substantially constant throughout the rotation of the rotor 320. As a result, the motor operates against relatively constant torque which greatly enhances the ability of the motor controller to turn rotor 320 at a constant rate, thereby minimizing any pulsations or variations in fluid flow due to torque variations.

Torque control cam 350 is preferably biased against each roller 324 in contact with it. The mechanisms for biasing the torque control cam 350 against each roller 324 could include any suitable alternative. In one particular embodiment, the torque control cam 350 may be spring loaded such that it is biased in the direction of the axis of rotation 322 as shown by arrow 351 in FIG. 6. In another variation, the surface 354 of the torque control cam 350 may be provided with a resilient material such as foam, or it may be provided with a piece of the same tubing used in the peristaltic pump to move fluid. In another variation, the biasing force applied to the torque control cam 350 may be controlled by, for example, a solenoid, such that a desired amount of biasing force is provided against each roller 324 in contact with the torque control cam 350. In such a system, the biasing force could be controlled in conjunction with the motor controller to assure even and uniform torque needed to advance the rotor 320 by an appropriate control system.

As described herein, the race of each of the rotary peristaltic pumps according to the present invention is formed with a race having an arcuate surface with a varying radius as measured from the axis of rotation of the rotor. It is envisioned that the present invention may be used in a variety of combinations. For instance, a peristaltic pump may be provided with a race having a varying radius to reduce pulsations in fluid flow from the pump without the assistance of a torque control cam. In another embodiment, the torque control cam used to adjust the torque needed to advance a rotor may be used in connection with a peristaltic pump having a conventional race, i.e., a race having a constant radius throughout a majority of its circumference. In that embodiment, the ability to reduce variations in torque needed to rotate the rotor may provide sufficient advantages in reducing variations in flow from the peristaltic pump that a race having a varying radius may not be required.

In yet another combination, peristaltic pumps according to the present invention may incorporate both features, i.e., a race having an arcuate surface with a varying radius, as well as a torque control cam to reduce variations in torque necessary to turn a rotor within the pump. It is that embodiment which may provide the greatest level of control and accuracy in fluid flow from a rotary peristaltic pump according to the present invention.

For example, one preferred peristaltic pump according to the present invention includes a race 114 having three sections in which the radius of Section I decreases, the radius if Section II is substantially constant, and the radius of Section III increases as discussed above and illustrated in FIGS. 3 and 4. In addition, it is also preferred that the peristaltic pump include a torque control cam 350. In such a pump, it is preferred that the rotor include five compression devices (e.g., rollers) and that each section of the race cover an arc of 72° as discussed above. Such a design allows space for tubing entry and exit in addition to controlling flow variations and torque.

It should also be understood that the various features of the present invention may also be incorporated in combination with other peristaltic pump designs and features to provide the desired result. For example, the present invention could be combined with a damping mechanism to produce a desired pulsatile flow as discussed in U.S. Pat. No. 4,976,593 to Miyamoto. In such an application, the ability of the present invention to provide a smooth accurate controllable flow from a peristaltic pump may enhance the ability to then provide the desired pulsatile flow due to the known and accurate flow rate emanating from the pump itself.

The patents cited herein are incorporated by reference in their entirety, as if each were individually incorporated by reference. Various modifications and alterations of this invention will become apparent to those skilled in the art without departing from the scope of this invention, and it should be understood that this invention is not to be unduly limited to the illustrative embodiments set forth herein.

What is claimed is:

1. A rotary peristaltic pump comprising:

a) a rotor adapted for rotation about a first axis;

b) a plurality of compression devices mounted on the rotor; wherein the compression devices move in a path about the first axis when the rotor is rotated;

c) a race positioned about a first portion of the path of the plurality of compression devices; and d) a torque control cam positioned about a second portion of the path of the plurality of compression devices, wherein the pump is adapted to compress a portion of tubing located between the race and at least one of the plurality of compression devices along the first portion of the path while at least one of the plurality of tube compression devices acts against the torque control cam along the second portion of the path, and further wherein the torque control cam is located such that the torque required to move the plurality of compression devices through the second portion of the path is at a maximum when the torque required to move the plurality of compression devices through the first portion of the path is at a minimum.

2. A pump according to claim 1, wherein the torque control cam resists rotation of the rotor such that the torque required to rotate the rotor remains substantially constant throughout the rotation of the rotor.

3. A pump according to claim 1, wherein the torque control cam includes a peak.

4. A pump according to claim 1, wherein the torque control cam is biased towards the axis of rotation of the rotor.

5. A pump according to claim 1, wherein the torque required to move the rotor about the first axis is substantially constant.

6. A rotary peristaltic pump comprising:

a) a rotor adapted for rotation about a first axis;

b) a plurality of compression devices mounted on the rotor; wherein the compression devices move in a path about the first axis when the rotor is rotated;

c) a race positioned about at least a portion of the rotor, wherein the race includes an arcuate surface curving around the axis of rotation and further wherein the arcuate surface has a radius as measured from the axis of rotation that varies; and d) a torque control cam positioned about a second portion of the path of the plurality of compression devices, wherein the pump is adapted to compress a portion of tubing located between the arcuate surface and at least one of the plurality of compression devices along the first portion of the path while at least one of the plurality of tube compression devices acts against the torque control cam along the second portion of the path.

7. A pump according to claim 6, wherein the radius varies continuously over at least a portion of the arcuate surface.

8. A pump according to claim 6, wherein the radius decreases in the direction of rotation of the rotor over at least a portion of the arcuate surface.

9. A pump according to claim 6, wherein the radius increases in the direction of rotation of the rotor over at least a portion of the arcuate surface.

10. A pump according to claim 6, wherein the radius decreases in the direction of rotation of the rotor over a first portion of the arcuate surface and increases in the direction of rotation of the rotor over a second portion of the arcuate surface.

11. A pump according to claim 6, wherein the arcuate surface comprises at least first, second, and third sections, the second section being located between the first and third sections, and further wherein the radii of the first and third sections are both different than the radius of the second section.

12. A pump according to claim 11, wherein the radii of the first and third sections vary continuously in the direction of rotation of the rotor.

13. A pump according to claim 11, wherein the radius of the first section decreases in the direction of rotation of the rotor and the radius of the third section increases in the direction of rotation of the rotor.

14. A pump according to claim 13, wherein the radius of the second section is substantially constant.

15. A pump according to claim 6, wherein the torque control cam resists rotation of the rotor such that the torque required to rotate the rotor remains substantially constant throughout the rotation of the rotor.

16. A pump according to claim 6, wherein the torque control cam includes a peak.

17. A pump according to claim 6, wherein the torque control cam is biased towards the axis of rotation of the rotor.

18. A pump according to claim 6, wherein the torque control cam is located such that the torque required to move the plurality of compression devices through the second portion of the path is at a maximum when the torque required to move the plurality of compression devices through the first portion of the path is at a minimum.

19. A pump according to claim 18, wherein the torque required to move the rotor about the first axis is substantially constant.

* * * * *